United States Patent [19]

Jasper, Jr. Louis J.

[11] Patent Number: 4,833,965

[45] Date of Patent: May 30, 1989

[54] ELECTROMAGNETIC RAILGUN/INJECTOR

[75] Inventor: Jasper, Jr. Louis J., Ocean, N.J.

[73] Assignee: The United States of America as represented by the Secretary of the Army, Washington, D.C.

[21] Appl. No.: 229,515

[22] Filed: Aug. 5, 1988

Related U.S. Application Data

[63] Continuation of Ser. No. 141,365, Dec. 28, 1987, which is a continuation of Ser. No. 910,915, Sep. 22, 1986, abandoned.

[51] Int. Cl.[4] ..... F41F 1/02

[52] U.S. Cl. ..... 89/8; 124/3; 310/12

[58] Field of Search ..... 89/8; 124/3; 310/10, 310/11, 12, 13, 14; 318/135

[56] References Cited

U.S. PATENT DOCUMENTS

| | | | |
|---|---|---|---|
| 4,319,168 | 3/1982 | Kemeny | 318/135 |
| 4,386,578 | 6/1983 | Haslund | 118/669 |
| 4,429,613 | 2/1984 | Deis et al. | 89/8 |
| 4,431,960 | 2/1984 | Zucker | 323/340 |
| 4,449,441 | 5/1984 | McAllister | 89/8 |

OTHER PUBLICATIONS

Homan et al., Evaluation of Superconducting Augmentation on Rail Gun Systems, IEEE Transactions on Magnetics, vol. Mag-20, No. 2, Mar. 1984.

Peterson et al., Rail Gun Powered by an Integral Explosive Generator, Proceedings of the Impact Fusion Workshop, Aug. 1979, pp. 234–244.

*Primary Examiner*—Stephen C. Bentley

*Attorney, Agent, or Firm*—Sheldon Kanars; John K. Mullarney

[57] ABSTRACT

An electromagnetic railgun. The device features two electrically connected parallel rails. One end of each rail may be connected to a D.C. voltage source. At least one of the rails has a hole for closely receiving a metallic projectile. When the projectile is within the hole and the voltage is applied, currents flow through the two rails. Interaction of the currents with the self generated magnetic field causes a repulsive force between the two rails and launches the projectile outward from the rails.

7 Claims, 4 Drawing Sheets

Prior Art

ELECTROMAGNETIC RAILGUN/INJECTOR

The invention described herein may be manufactured used, and licensed by or for the Government for governmental purposes without the payment of any royalties thereon or therefor.

This application is a continuation of application Ser. No. 141,365, filed Dec. 28, 1987. Application Ser. No. 141,365 was, in turn, a continuation of application Ser. No. 910,915, filed Sept. 22, 1986, which is now abandoned.

TECHNICAL FIELD

This invention relates generally to guns and projectile launchers and more particularly to devices which launch bullets or projectiles by utilizing electromagnetic energy instead of chemical propellants.

BACKGROUND OF THE INVENTION

Conventional guns and projectile launching weapons utilize the burning of chemical propellants to achieve high projectile velocity. In recent years there has been a renewed interest in projectile launchers which utilize electromagnetic energy. Such electromagnetic launchers may find application in space launched weaponry and impact fusion as well as in more conventional ordinance. Generally speaking, electromagnetic launchers promise higher projectile velocities than launchers utilizing chemical propellants.

One prior art design currently receiving considerable attention is the electromagnetic railgun. A conventional prior art electromagnetic railgun utilizes two long parallel rails capable of carrying a large current. A sliding, conducting armature is positioned between the two rails. The armature is adapted to slide between the two rails along their entire length. Application of a voltage across two ends of the two rails causes a large current pulse to flow through one rail, thence through the armature, and into the other rail. The current generates a magnetic field. The Lorentz force created by the interaction of the magnetic field with the current in the armature causes the armature to be rapidly propelled between the two rails in a direction away from the points of application of the voltage. The armature itself may be projected like a bullet at a target, or the armature may be used to push a bullet-type projectile at high velocity towards a chosen target, and the armature ultimately slowed and retained with the device for future shots.

A disadvantage of the conventional railgun is that arcing and heating may occur between the armature and rails. The heating is due to $I^2R$ losses and the arcing is due to poor contact between the armature and rails.

Maintaining good electrical contact between the armature and the rails over the entire length of the rails without causing too much friction is a serious problem which has impeded rail gun development to date. If the contact between the armature and rails is too tight, friction slows the armature, metal fusion occurs, and degrades projectile velocity. If the contact between the armature and rails is too loose, arcing occurs.

Other embodiments of the conventional prior art railgun utilize multiple sets of parallel rails, with the sets positioned alongside each other or on top of each other and separated by insulating layers. Similarly, the armature has multiple conducting segments separated by a thickness of insulation. The multiple sets of rails are connected in series so that the armature is in a unidirectional magnetic field region. Both mutual inductance and self inductance contribute to forces on the compound armature. However, the multi-layered railgun presents more severe interfacial problems than the aforementioned single layered railgun.

Finally, another type of electromagnetic launcher, called the reconnection gun is described in an article entitled "The Reconnection Gun", by M. Cowan et. al. in Proceedings of the Third Symposium on Electromagnetic Launch Technology, April 1986. The reconnection gun consists of two rectangular coaxial coils which are spaced apart by a relatively small gap. The projectile, which is a rectangular plate, passes through the gap aimed in a direction which is orthogonal to the axes of the coils. Acceleration of the projectile is the result of magnetic field line reconnection which takes place behind the projectile as it passes through the gap. The reconnection gun, however, boils away material from the rear of the projectile, as it is accelerated, thus reducing projectile mass.

SUMMARY OF THE INVENTION

It is an object of the present invention to provide a gun which does not require a chemical propellant.

It is another object of the present invention to provide a simple, compact electromagnetic projectile launcher.

A further object of the present invention is to provide an electromagnetic projectile launcher with minimal heating and arcing deficiencies.

A still further object of the present invention is to provide a projectile launcher which does not reduce the projectile's mass during acceleration.

An additional object of the present invention is to provide maximum force on a projectile for a given current.

The present invention utilizes two parallel rails akin to the rails featured in a conventional prior art rail gun. The ends of the rails are joined by a conductor. However, there is no sliding armature between the rails. By contrast, the present invention utilizes the repulsive force which tends to push two parallel wires (or rails) apart when they carry currents in opposite directions. Thus, when a voltage is applied to the unconnected ends of the two rails, a current flows in opposite directions through the two parallel rails and creates a strong force tending to drive the rails apart. The repulsive force caused by the parallel currents is utilized to launch a projectile in the following manner: one of the rails is split, creating a gap, so that application of the aforementioned voltage does not cause any current flow. Both the split rail and the other rail are securely anchored a fixed distance apart. A metal projectile is introduced into the gap between the halves of the split rail so that it touches both halves of the split rail and completes an electrical circuit. A large current suddenly flows in opposite directions through the two parallel, anchored rails, and the projectile is suddenly and forcibly launched perpendicular to the split rail by the force of repulsion between the oppositely flowing currents in the two rails.

Thus, the present invention launches a projectile in a direction perpendicular to two parallel rails within the plane of those rails. By contrast, the aforementionted prior-art railgun launches a projectile in a direction parallel to two long rails.

The inventive principles of the present invention are applicable to small-bore hand-held guns, as well as larger-bore stationary artillery, and even to space-based anti-missile defenses.

BRIEF DESCRIPTION OF THE DRAWINGS

Further objects and advantages of the present invention will become apparent with those familiar with the art upon examination of the following detailed description and accompanying drawings in which.

DETAILED DESCRIPTION OF THE PREFERRED EMBODIMENTS

Figure 1:
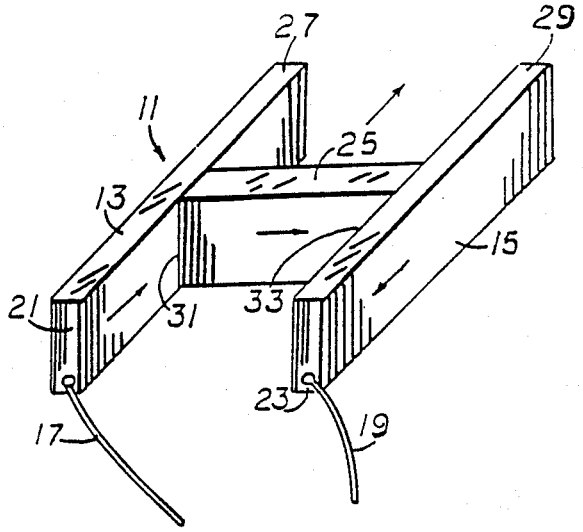
FIG. 1 is a schematic perspective view of a typical prior art device.

Referring to the drawings, and particularly to FIG. 1, reference numeral 11 designates generally a prior art device. Two anchored parallel conductive rails are denoted respectively by reference numerals 13 and 15. Ends 21 and 23 of rails 13 and 15 respectively are connected via leads 17 and 19 to a voltage source (not shown).

Armature 25 fits closely between rails 13 and 15. Application of a high voltage between leads 17 and 19 causes current to flow (depending upon polarity) into end 23 of rail 15, thence through armature 25, and out through end 21 and lead 17. Reversal of the voltage polarity causes current to flow in the other direction, i.e. into lead 17 and out from lead 19. In any event, the aforementioned current creates a magnetic field between the rails perpendicular to the plane of the rails 13 and 15. The Lorentz force created by interaction between the current flowing through armature 25 and the magnetic field creates a force upon the armature 25 which rapidly accelerates the armature 25 toward ends 27 and 29 of rails 13 and 15 respectively. The armature 25 may be an integral part of a bullet-like projectile or the armature 25 may simply serve to provide acceleration for a separate detachable bullet-like projectile. As mentioned before, arcing and heating may occur at the interfaces 31 and 33 between the armature 25 and rails 13 and 15. Proper operation of the device 11 depends upon maintenance of good electrical contact between armature 25 and rails 13 and 15 over the entire length of the rails.

Another device, known in the prior art, features two or more structures, similar to that illustrated in FIG. 1, stacked one upon another, separated by layers of insulation. The left end 21 of each upper device is electrically connected to the right end 23 of the device immediately below it. The armature 25, is composed of alternating layers of metal and insulation, similar to the rail structure. Application of a high voltage to the upper right hand rail and lower left hand rail produces a force which accelerates the armature toward ends 27 and 29 of the device. The aforementioned device is called a multi-layered or multiple-turn rail gun. Mutual inductance as well as self inductance contributes to the force on the projectile. An obvious disadvantage of the multi-layered railgun is that the multi-layers create severe interfacial problems. All of the metallic armature layers must have exellent contact with their respective rail segments as the armature travels along the rails, lest a voltage drop occur between a rail and armature layer, causing arcing and rail damage.

Figure 2:
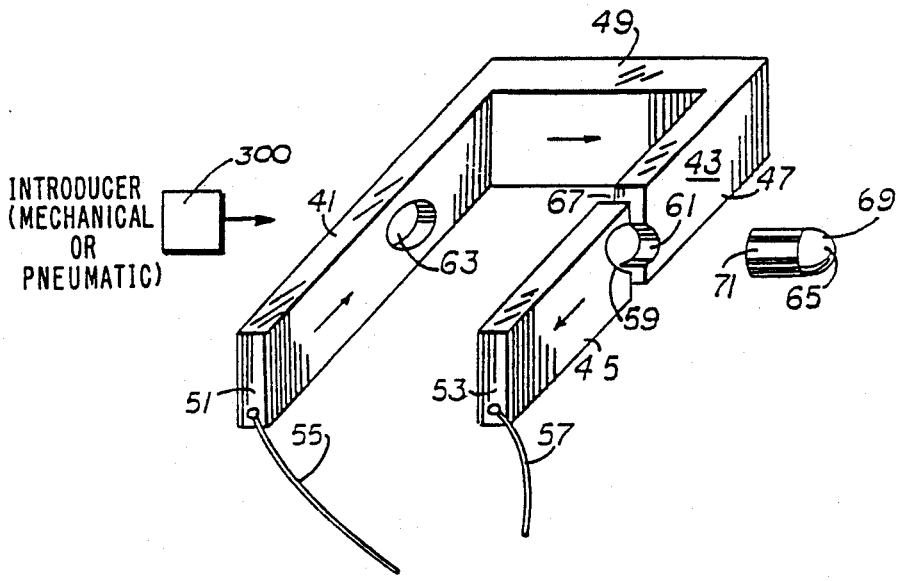
FIG. 2 is a schematic perspective view of a preferred embodiment of the present invention.

FIG. 2 is schematically illustrative of one preferred embodiment of the present invention. The device shown in FIG. 2 features two long, electrically conductive, rails 41 and 43. The rails are joined by a comparatively short conductive section 49. The length of the rails 41 and 43 is considerably longer than the length of section 49. Section 49 need not physically resemble rails 41 and 43 at all. The only purpose of section 49 is to conduct current from rail 41 to rail 43 (or vice-versa), and so, section 49 may be conductive wire or cable. The entire assembly, consisting of rails 41 and 43 and section 49 is immovably anchored on a platform (not shown). Rail 43 is split into two sections, 45 and 47. A gap 67 separates halves 45 and 47. Rails 45 and 47 have semi-circular notches 59 and 61 respectively adjacent gap 67. A generally cylindrical metal projectile 65 is dimensioned so that it will fit closely within the hole defined by semi-circular notches 59 and 61 and thereby provide continuous electrical contact between rail halves 45 and 47 of rail 43.

A DC voltage source (not shown) is connected via leads 55 and 57 to ends 51 and 53 respectively, of rails 41 and 45. The presence of the gap 67 prevents current from flowing through rails 41, 49 and 43. However, should a metallic, conducting projectile 65 be introduced into the gap 67 so that the projectile 65 fits closely within the hole defined by semicircular notches 59 and 61, current will flow through rail 43. The projectile, being unrestrained, will be launched outward, perpendicular to rails 41 and 43.

A hole 63 in rail 41 permits introduction of the projectile 65 from the left. There is no gap in rail 41; consequently, current may flow unimpeded through rail 41 despite the presence of the hole 63. The diameter of the hole 63 must be larger than the diameter of the projectile 65. Hole 63 is directly opposite the hole defined by semi-circular notches 59 and 61. The projectile 65 may be introduced from the left through hole 63 by mechanical or pneumatic means 300. For example, a pneumatic tube may be used to shoot projectile from the left through hole 63. The projectile then traverses the space between rails 41 and 43, ultimately coming to the hole defined by notches 59 and 61. When the projectile 65 contacts the hole defined by notches 59 and 61, the projectile 65 functions like a closed switch, permitting a sudden large current to flow through rails 41, 49 and 43. The resulting repulsive force between rails 41 and 43 provides an acceleration to projectile 65, causing the projectile 65 to be hurtled to the right.

In a preferred embodiment of the present invention, rails 41 and 43 are 0.58 meters long and the spacing between the rails (i.e. the length of rail 49) is 0.001 meters (0.375 inches). The configuration shown schematically in FIG. 2 is suitable for application of DC voltages less than 1000 volts to leads 55 and 57. The voltage may be provided by a capacitor bank charged by batteries or any other suitable means. In a preferred embodiment, the capacitor bank is charged to 500 volts producing a peak current of 250 kiloamperes. The projectile 65 has a curved phenolic header section 69 and a cylindrical metallic section 71 made from sixty-five copper discs of 0.2265 diameter. The purpose of the optional phenolic header is to improve aerodynamic performance and to allow the projectile to be seated in the hole defined in rail 43 before the metallic section 71 makes contact with the sides of the notches 59 and 61. The total weight of the projectile 65 is 1.3 grams.

The following theoretical analysis provides a quantitative comparison between a single-turn rail gun of the prior art design as shown in FIG. 1 and the embodiment of the inventive device illustrated in FIG. 2. In FIG. 1, the force on the moving armature 15 is due to the Lorentz force which may be expressed by:

$$F_1 = \frac{1}{2} I^2 \frac{dL}{dz} \tag{1}$$

where:

$F_1$=force parallel to rails

I=current through rails dl/dz=self inductance per length (inductance gradient)

The self inductance gradient, dl/dz for single-turn rail gun ranges from 0.4 to 0.7 microHenries per meter ($\mu$H/m). The self inductance gradient for an N-turn or N-layered railgun is theoretically $N^2$ times that of the single-turn railgun. However, prior art railguns have been built using as many as six turns which provide an inductance gradient as great as 40$\mu$H/m. The larger value of the inductance gradient indicates that there is considerable mutual inductance present in addition to self-inductance.

Now, considering FIG. 2, an expression for the force on the metallic section 71 of projectile 65 will be derived. When the metallic section 71 of projectile 65 is positioned in the hole defined by notches 59 and 61, a current flows in rail 43. The magnetic field, $B_1$ generated by the current flowing in rail 43 is:

$$B_1 = \frac{\mu_o I}{2\pi r} \tag{2}$$

where

I=current through rail r=radial distance from rail 43 (r=o at center of rail thickness)

$\mu_o$=permeability of free space

Similarly, the magnetic field $B_2$ generated by the current flowing in rail 41 is:

$$B_2 = \frac{\mu_o I}{2\pi(d_2 - r)} \tag{3}$$

where $d_2$=distance between centers of rails 41 and 43

For linear medium between the rails, the net magnetic field is given by:

$$B = B_1 + B_2 = \frac{\mu_o I d_2}{2\pi(d_2 - r)r} \tag{4}$$

If the thickness of the rail 43 is given by 2a, the magnetic field at the inner surface of rail 43 is calculated by setting r=a:

$$B_a = \frac{\mu_o I d_2}{2\pi(d_2 - a)a} \text{ for } r = a \tag{5}$$

Now, the repulsive force acting on rail 43 due to rail 41, may be computed.

The magnetic field at the inner surface of rail 43 is given by equation (5). However, the magnetic field (equation (2)) generated by current flowing in rail 43 must be subtracted out, since field generated by rail 43 will cancel with the oppositely directed field on the other side of rail 43 at r=−a. Consequently, the effective magnetic field at the inner surface or rail 43 is given by:

$$B_{a\,\text{effective}} = \frac{\mu_o I d_2}{2\pi(d_2 - a)a} - \frac{\mu_o I}{2\pi a} = \frac{\mu_o I}{2\pi(d_2 - a)} \tag{6}$$

The above equation neglects flux linkages inside the rails.

The force, $F_2$, per unit length, l, acting on rail 43 is therfore given by:

$$\frac{F_2}{l} = B_{a\,\text{effective}}\, I = \frac{\mu_o I^2}{2\pi(d_2 - a)} \tag{7}$$

Consequently, the force generated by the inventive device is:

$$F_2 = \frac{\mu_o I^2 l}{2\pi(d_2 - a)} \tag{8}$$

A comparison of equations (1) and (8) provides a comparison of the force acting on a projectile in the conventional single-turn rail gun of FIG. 1 and the force acting on a projectile in the inventive device of FIG. 2. The induction gradient, dl/dx for two parallel wires can be approximated by:

$$\frac{dL}{dx} = L' = \frac{\mu_o}{\pi} \ln \frac{d_1}{a} \tag{9}$$

where $d_1$=distance between the centers of each of the rails of FIG. 1.

Substituting equation (9) into equation (1) provides an expression for the force in the conventional single-turn railgun of FIG. 1:

$$F_1 = \frac{1}{2} I^2 L' = \frac{\frac{1}{2} I^2 \mu_o \ln \frac{d_1}{a}}{\pi} \tag{10}$$

The ratio of the force provided by the conventional railgun of FIG. 1 and the inventive device disclosed in FIG. 2 is provided by the ratio of equations (8) and (10):

$$\frac{F_2}{F_1} = \frac{l}{(d_2 - a)\ln \frac{d_1}{a}} \tag{11}$$

It is important to note in equation (11) that $d_1$ is the spacing between the centers of the rails 13 and 15 of FIG. 1, i.e. effectively the width of the armature 25 plus the thickness of a rail, whereas $d_2$ is the spacing between the centers of rails 41 and 43 of FIG. 2. The spacing $d_1$ for rails 13 and 15 is limited by the size of the armature 25 (projectile). However, the spacing, $d_2$, for rails 41 and 43 can be smaller than the diameter of the projectile 65 if desired. In fact, the rails 41 and 43 can almost touch. For comparison, let $d_1=2a=d_2$. Then as can be seen for $l>>a$, $F_2>>F_1$. In a preferred embodiment, the device of FIG. 2 has $l=1.0$ in., and $a=3/32$ in. Consequently, $$\frac{F_2}{F_1} = 15.4 \tag{12}$$

Equation (12) illustrates that to achieve equal acceleration for a projectile, the time during which the accelerating force in the inventive device must act upon the projectile need be 1/15.4 less than the time required if the projectile is to be accelerated in conventional device of FIG. 1. An important feature of the invention device is that the rails may be positioned extremely close together and still accommodate a large diameter projectile—a condition unachievable with a conventional railgun.

The inventive device of FIG. 2 may be modified in various ways. Hole 63 in rail 41 may be eliminated. It is then necessary to introduce the projectile 65 into the hole defined by notches 59 and 61 from between rails 41 and 43 (if the rails are far enough apart) or to introduce projectile 65 into holes 59 and 61 from the right hand side of the device (with the voltage source disconnected). In another embodiment, gap 67 may be eliminated leaving only a circular hole in rail 43 to contain the projectile. The current through the device may be activated by an external switch.

Figure 3:
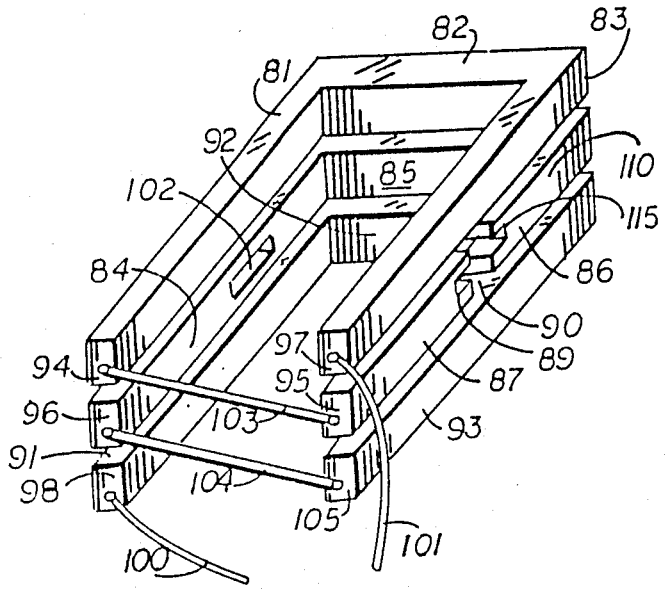
FIG. 3 is a schematic perspective view of another embodiment of the present invention.

FIG. 3 illustrates an alternative embodiment of the present invention. The device of FIG. 3 has three sets of rails and is suitable for application of voltages in the range of 1000 to 5000 volts. The device of FIG. 3 consists essentially of three sets of rails electrically interconnected to constitute one coil with three turns. The projectile is ejected from the side of the center pair of rails. In particular, reference numerals 81 and 83 designate two long parallel upper rails, connected by a short rail 82. Spaced directly beneath the aforementioned set of rails, 81, 82 and 83, is a second set of rails, 84, 85, and 110. Rails 84 and 110 are long parallel rails positioned directly beneath their counterparts, rails 81 and 83. Long rails 84 and 110 are connected by short rail 85. There is a hole 102 in rail 84. The hole 102 facilitates the introduction of a projectile (not shown) from the left of the drawing. Rail 110 is split at gap 90 into two halves, 86 and 87. Each half of rail 110 contains a notch 89 and 115. The notches 89 and 115 are illustrated as rectangular while, notches 59 and 61 of FIG. 2 were illustrated as circular. The shape of the notch is immaterial as long as the notch fits the projectile closely enough to make good electrical contact. The end 94 of rail 81 is connected to the end 95 of rail 87 by connecting lead 103. Spaced directly beneath the aforementioned two sets of rails is a third set. Rail 91 is directly beneath rails 84 and 81, rail 92 is directly beneath rails 85 and 82. Rail 93 is directly beneath rails 110 and 83. Rails 91, 92 and 93 are electrically connected together. The end 96 of rail 84 is electrically connected to the end 105 of rail 93 by connecting lead 104.

End 98 of rail 91 is connected via a lead 100 to a DC voltage source (not shown). Similarly, end 97 of rail 83 is connected to the opposite polarity of the same DC voltage source by lead 101. In operation, the projectile is pneumatically or mechanically injected from the left through hole 102. As the metallic portion of the projectile contacts the sides of notches 115 and 89, it serves as a switch, closing the DC circuit and permitting current to flow through the coil. The projectile is ejected at high speed to the right of FIG. 3.

In the embodiments of both FIG. 2 and FIG. 3 the current flows through the circuit when the switch is closed (i.e. when the metallic portion of the projectile contacts the respective sides of the notches), and the magnetic field is created by the current itself.

Figure 4:
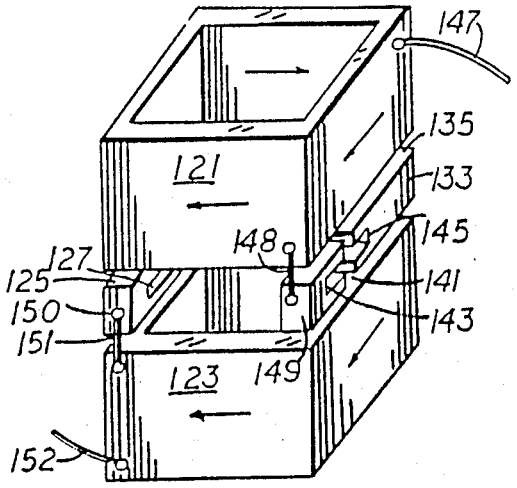
FIG. 4 is a schematic perspective view of another embodiment of the present invention.

FIG. 4 is illustrative of an embodiment of the present invention suitable for application of voltages greater than 5000 volts. In the embodiment of FIG. 4, rails 125 and 133 are parallel and connected by section 135. Rail 125 has a hole 127 for admitting the projectile from the left. Rail 133 has a gap 141. Notches 145 and 143 are adjacent gap 141. Notches 145 and 143 fit closely about the projectile (not shown). Two coils 121 and 123 are positioned respectively above and below rails 125, 135 and 133. One end of coil 121 is connected by lead 147 to a DC voltage source (not shown). The other end of coil 121 is connected by lead 148 to end 149 of rail 133. End 150 of rail 125 is connected by a lead 151 to one end of coil 123. The other end of coil 123 is connected by lead 152 to the opposite polarity of the aforementioned DC voltage source. A representative current flow pattern is illustrated by the arrows in FIG. 4. The current flow pattern of FIG. 4 is topologically similar to that of FIG. 3. The only distinction between the embodiments of FIG. 3 and FIG. 4 is that the upper and lower rail sets, 81, 82, 83 and 91, 92, and 93 of FIG. 3 have been replaced by coils 121 and 123 respectively. The embodiment of FIG. 4 provides greater inductance, thus producing higher projectile velocity. The projectile enters hole 127 from the left and procedes to the hole defined by notches 143 and 145. When the projectile makes sliding contact with the hole defined by notches 143 and 145, it closes an electric circuit as in previous examples, and the resulting repulsive forces between rails 125 and 133 accelerate the projectile to the right, away from the device.

A variation of the embodiment of FIG. 4 is also possible: In the embodiment of FIG. 4, there is a continuous current path from lead 147 through coil 121, through rail 133 (when the hole defined by notches 143 and 145 is closed by a projectile) through rail 135 through rail 125, thence through coil 123 and lead 152. However, coils 121 and 123 may be energized by an independent, separate DC voltage source, while leads 148 and 151 are disconnected from coils 121 and 123 respectively and instead connected to a second DC voltage source. The projectile launcher formed by rails 125, 135 and 133 and their respective second voltage source would function similar to the launcher depicted in FIG. 2. The separately energized coils, positioned above and below the rails would augment the magnetic field created by current in the rails and thus, increase projectile acceleration. A permanent magnet may also be employed in lieu of or to augment the coils.

Figure 5:
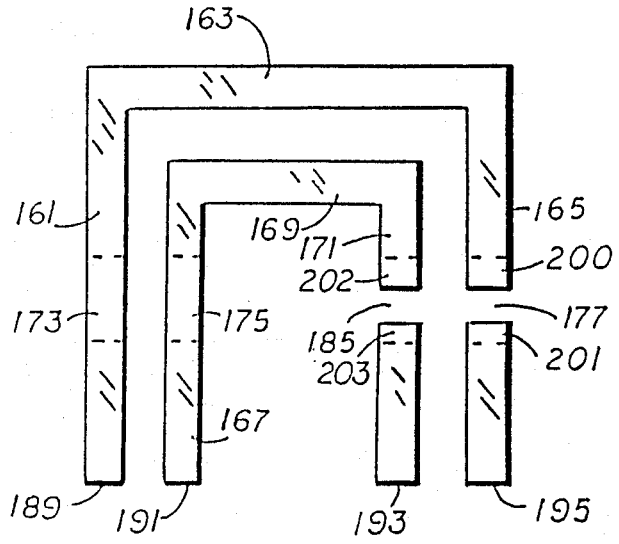
FIG. 5 is a schematic top plan view of another embodiment of the present invention.

FIG. 5 is illustrative of yet another embodiment of the present invention concept. FIG. 5 illustrates two nested pairs of rails which operate similar to the devices already described. Although FIG. 5 illustrates only two nested pairs of rails, a plurality of pairs of nested rails may be employed in other embodiments. In FIG. 5, rails 161 and 165 are connected by section 163. Similarly, rails 167 and 171 are connected by section 169. Holes 173 and 175 are positioned in rails 161 and 167 respectively, to admit the projectile from the left. Rails 165 and 171 are split respectively by gaps 177 and 185. End 189 of rails 161 and end 195 of rail 165 are connected to the same voltage source. End 191 of rail 167 and 193 of rail of 171 are connected to another separate voltage source. The polarity of the voltage source is chosen so that the forces between rails 161 and 167 and between rails 165 and 171 are repulsive with current flowing in the opposite direction through them.

Gap 177 is contiguous with a pair of notches 200 and 201, while gap 185 is contiguous with a pair of notches 202 and 203. Both pairs of notches define a hole which closely fits the projectile (not shown). The projectile is injected from the left of the diagram into hole 173, from which it passes through hole 175 and thence to the hole defined by notches 202 and 203. Contact between the projectile and the hole defined by notches 202 and 203 serves to close the electrical circuit created by connection of ends 191 and 193 to a DC voltage source. The projectile is accelerated into the hole defined by notches 200 and 201, where it again acts like a switch, contacting the sides of the notches and closing the electrical circuit created by the connection of ends 189 and 195 to a DC voltage source.

Figure 6:
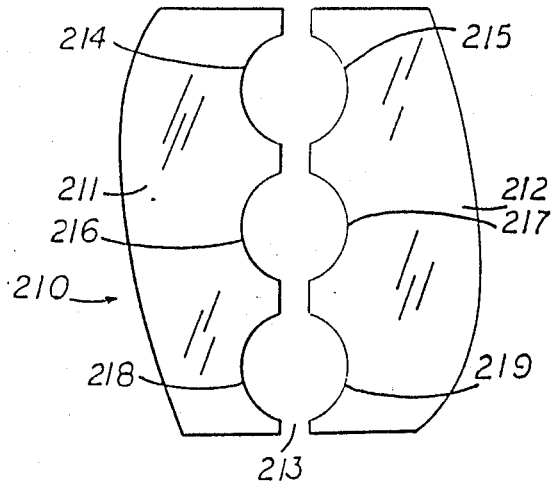
FIG. 6 is a side view of another embodiment of the present invention.

FIG. 6 is a side view of another embodiment of the present invention. FIG. 6 is illustrative of a section of a rail which may be be used to continuously launch a plurality of projectiles. Reference numeral 210 denotes a rail which is split into two halves, 211 and 212 by gap 213. Three pairs of notches, 214 and 215, 216 and 217, 218 and 219 are dimensioned to closely receive three projectiles. The configuration depicted by rail 210 in FIG. 6 may be substituted for rail 43 in FIG. 2, or rail 110 in FIG. 3, or rail 133 in FIG. 4.

Figure 7:
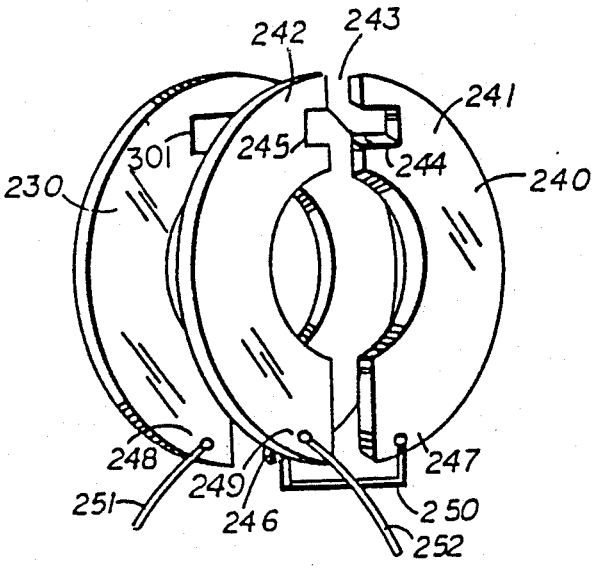
FIG. 7 is a schematic perspective view of another embodiment of the present invention.

FIG. 7 is illustrative of another embodiment of the present invention. The device of FIG. 7 utilizes the same inventive principles as the devices illustrated in FIGS. 2–6. However, the device of FIG. 7 features rails which are curved into a generally circular shape to save space. In FIG. 7 rails 230 and 240 are both curved into generally circular configurations. Rail 240 is split into two halves 241 and 242 by gap 243. Notches 244 and 245 are contiguous to gap 243. The notches 244 and 245 are dimensioned to closely receive a projectile (not shown). Rail 230 has a hole 301 to permit introduction of the projectile from the left of the figure. End 246 of rail 230 is electrically connected to end 247 of rail 240 by connecting lead 250. End 248 of rail 230 and end 249 of rail 240 are connected to a DC high voltage source via leads 251 and 252 respectively. A projectile may be introduced from the left of the figure through hole 301 by mechanical or pneumatic means. The projectile travels through the space between rails 230 and 240 and then contacts the sides of notches 244 and 245, completing an electrical circuit. The mutual repulsive force between rails 230 and 240 accelerates the projectile to the right of FIG. 7.

The device described in FIG. 7 is similar to the device described in FIG. 2—the only difference being that the rails 240 and 230 in FIG. 7 are curved into a generally circular shape. The high-inductance, multiple-turn devices shown in FIGS. 3 and 4 may, of course, be configured similar to the device of FIG. 7 by merely curving their respective rails. Also, rail 240 of FIG. 7 may be configured to accommodate multiple projectiles in a manner identical to that shown in FIG. 6.

Finally, the following remarks are applicable to all the embodiments discussed above. Performance of each of the aforementioned devices will be improved by the use of superconducting rails. While the cooling apparatus necessary to achieve the superconducting state might make a hand-held weapon a bit cumbersome, superconducting rails are feasible for stationary or space-based applications. Also, the embodiment of FIG. 4 may be modified by making coils 121 and 123 superconducting. As mentioned before, the coils may be, if necessary, electrically disconnected from rails 125 and 133. The coils may be energized by a separate current source. Such a configuration would require two voltage sources, one source to energize the coils, and the other source to energize the rails.

Furthermore, all of the embodiments disclosed above may be adpated to simultaneously launch projectiles in opposite (i.e. 180° apart) directions. For example, the embodiment of FIG. 2 may be modified by insertion of a switch in lead 55 or lead 57. With the switch open, two projectiles may be loaded into the device. One projectile may be placed in hole 63 and the other projectile in the hole defined by notches 59 and 61. Closing of the switch will cause both projectiles to be ejected 180° apart. In such an embodiment, gap 67 may be eliminated and a simple hole (similar to hole 63) may be bored in rail 43 to receive the projectile. Such a device would eliminate recoil.

Furthermore, all of the above-described embodiments may be arranged one after another sequentially, each device serving to accelerate a projectile into the next device from which it receives a further acceleration boost, and so on.

The illustrative embodiments herein are merely a few of those possible variations which will occur to those skilled in the art while using the inventive principles contained herein. Accordingly, numerous variations of invention are possible while staying within the spirit and scope of the invention as defined in the following claims.

What is claimed is:

1. A device for accelerating a projectile comprising:

first and second electrically connected rails spaced a parallel predetermined distance apart, the first of said rails having a gap therethrough dimensioned to closely receive said projectile;

means for producing a magnetic field oriented perpendicular to the plane of said rails, said means including a first coil electrically connected to said first rail and a second coil electrically connected to said second rail; and means for applying a voltage across said first and second rails so that presence of said projectile in said gap causes current to flow through said first and second rails and produces acceleration of said projectile from said gap away from said rails.

2. A device for accelerating a projectile comprising:

first and second electrically connected rails spaced a parallel predetermined distance apart, the first of said rails having a gap therethrough dimensioned to closely receive said projectile, said gap severing said first rail;

a rigid conductor electrically connecting said first and second rails;

means for producing a magnetic field oriented prependicular to the plane of said rails, said means being positioned above and below said rails, said means including a first coil electrically connected to said first rail and a second coil electrically connected to said second rail; and means for applying a voltage across said first and second rails so that presence of said projectile in said gap causes current flow through said first and second rails and produces acceleration of said projectile from said gap away from said rails.

3. An electromagnetic railgun for accelerating a projectile comprising a pair of coextensive parallel conductive rails spaced a predetermined distance apart, means for electrically connecting the rails at one end thereof, one of said rails having a gap therethrough dimensioned to closely receive the projectile, said gap serving to separate said one rail into two sections, a hole in the other rail directly opposite the gap, said hole being slightly larger in size than the projectile, a pair of magnetic means for producing a magnetic field oriented perpendicular to the plane of the rails, said pair of magnetic means being respectively positioned above and below said rails, and means for applying a voltage to said pair of rails so that the presence of said projectile in said gap causes current to flow through the pair of rails so as to produce acceleration of said projectile from said gap away from said rails.

4. A railgun as defined in claim 3 wherein the magnetic field produced by said magnetic means augments the magnetic field created by current in the rails.

5. A railgun as defined in claim 4 wherein said pair of magnetic means comprises coils or solenoids.

6. A railgun as defined in claim 5 wherein said coils are comprised of superconductive material.

7. A railgun as defined in claim 6 wherein said rails are comprised of superconductive material.

* * * * *